US008430297B2

(12) United States Patent
Gatrost et al.

(10) Patent No.: US 8,430,297 B2
(45) Date of Patent: Apr. 30, 2013

(54) SHIPPING AND DISPLAY CARTON AND BLANKS FOR PRODUCING SAME

(75) Inventors: Thomas Gatrost, Scottsdale, AZ (US); Stephen Koven, Scottsdale, AZ (US); Reena Patel, Mesa, AZ (US); Ashley Wilkum, Phoenix, AZ (US); John Waidelich, Archbold, OH (US)

(73) Assignee: The Dial Corporation, Scottsdale, AZ (US)

( * ) Notice: Subject to any disclaimer, the term of this patent is extended or adjusted under 35 U.S.C. 154(b) by 412 days.

(21) Appl. No.: 12/899,864

(22) Filed: Oct. 7, 2010

(65) Prior Publication Data

US 2012/0085817 A1 Apr. 12, 2012

(51) Int. Cl.
*B65D 17/00* (2006.01)
*B31B 17/00* (2006.01)

(52) U.S. Cl.
USPC ..... 229/240; 493/84

(58) Field of Classification Search ..... 229/211, 229/117.17, 243, 125.32; 206/736, 192, 206/430
See application file for complete search history.

(56) References Cited

U.S. PATENT DOCUMENTS

| | | | | |
|---|---|---|---|---|
| 1,609,186 | A | 11/1926 | Peruzzi | |
| 3,917,158 | A | 11/1975 | Dorofachuk et al. | |
| 4,113,100 | A | 9/1978 | Soja et al. | |
| 4,553,666 | A | 11/1985 | Gullikson | |
| 5,447,225 | A | 9/1995 | Gunn et al. | |
| 5,715,993 | A | 2/1998 | Pareike | |
| 5,842,576 | A | 12/1998 | Snow | |
| 6,203,482 | B1 | 3/2001 | Sandford | |
| 6,510,982 | B2 | 1/2003 | White et al. | |
| 6,974,033 | B2 | 12/2005 | McLeod et al. | |
| 7,066,379 | B2 | 6/2006 | McLeod et al. | |
| 7,175,066 | B2 | 2/2007 | Varanasi | |
| 7,234,596 | B2 * | 6/2007 | Lebras | 206/427 |
| 7,410,062 | B2 | 8/2008 | Monk | |
| 7,451,878 | B2 | 11/2008 | Rochefort et al. | |
| 7,478,745 | B2 | 1/2009 | Philips | |
| 7,628,746 | B2 | 12/2009 | Varanasi | |
| 7,681,727 | B2 | 3/2010 | Hunt et al. | |
| 2004/0222127 | A1 * | 11/2004 | McLeod et al. | 206/736 |
| 2007/0221715 | A1 * | 9/2007 | Tibbels et al. | 229/125.19 |
| 2009/0014352 | A1 * | 1/2009 | Foden | 206/746 |
| 2010/0043360 | A1 | 2/2010 | DeBusk et al. | |

FOREIGN PATENT DOCUMENTS

| | | | |
|---|---|---|---|
| EP | 2014560 | B1 | 1/2009 |
| FR | 2713597 | A1 | 6/1995 |

* cited by examiner

*Primary Examiner* — Gary Elkins
*Assistant Examiner* — Christopher Demeree
(74) *Attorney, Agent, or Firm* — Paul A. Pappalardo

(57) ABSTRACT

A shipping and display carton convertible into a cover portion and display tray is described comprised of a cover portion formed from a cover blank and a tray portion formed from a tray blank. The blanks are preferably glued together at only three glue points when the tray blank is laid flat on top of the cover blank in order to form a two-layered blank that may be erected into the present carton. The fully erected carton may be easily broken apart into an attractive display tray and a disposable/recyclable cover by gripping the cover within a grasping aperture and lifting the cover portion up to break the carton apart at the two side tabs and along the rear of the carton.

11 Claims, 6 Drawing Sheets

SHIPPING AND DISPLAY CARTON AND BLANKS FOR PRODUCING SAME

FIELD OF INVENTION

The present invention relates to combination shipping/display cartons and in particular to a shipping/display carton formed from two separate blanks.

BACKGROUND

Combination shipping/display cartons are thoroughly described in the patent literature and commonly found throughout the packaging industry. For example, as early as 1926, M. Paruzzi patented a display carton that was formed from a single blank comprising both cut and perforated lines, (U.S. Pat. No. 1,609,186). Cartons were improved through the decades to provide for greater strength, easier conversion to display trays, and other features such as internal dividers or the ability to stack into store displays. Such shipping/display cartons may be constructed from single blanks or two or more blanks. Use of two separate blanks to form a carton requires alignment and gluing together of the blanks prior to erection of the final carton. Some single blanks have complex die-cut patterns with trapped cutouts that lead to waste/recycle, and such complex blanks require custom conversion machinery to erect. Some of the improvements claimed over the years are highlighted in the following discussion of the prior art.

U.S. Pat. No. 3,917,158 (Dorofachuk, et al.) claims a display carton formed from a single blank where the carton is convertible to a display tray by complete separation of the front panel, portions of the side panels and a portion of the rear panel. Conversion to the display tray requires separation along very long lines of perforations, leaving behind rough edges on the display tray.

U.S. Pat. No. 4,113,100 (Soja, et al.) claims a display carton formed from a foldable blank wherein tear strips are provided for separation of a cover member from the display tray member. The tear strip of the claimed carton circumscribes the entire circumference of the carton and must be removed in its entirety to separate the top portion from the bottom portion and render the bottom portion usable as a display tray.

U.S. Pat. No. 4,553,666 (Gullikson) claims a reinforced shipping/display carton that includes end flaps of doubled thickness. The separation of the upper portion from the display tray requires cutting around the carton along a demarcated "cut designating line," followed by separation along two short perforated lines on the carton flaps.

U.S. Pat. No. 5,447,225 (Gunn, et al.) claims a tray/shroud shipping container where the shroud is removed from the lower tray by unlocking a number of tabs. The shroud telescopes within the tray and is locked in by the cooperation of tabs and small cut outs. However, it is suggested that the tray also be secured to the shroud with adhesive.

U.S. Pat. No. 5,715,993 (Pareike) claims a foldable carton formed from a single blank where the top cover portion is separable from the bottom tray portion by tearing off two short tear-strips, which are present on each of the inner side walls and accessible from the outside of the carton through cutouts or punch-outs on the outer tray walls. This carton seems to be of lightweight utility because the upper portion of the carton is only held to the tray by these small tear-strips. Furthermore, the tray portion of the carton will be left with these two cutouts on each side of the tray after separation of the upper portion, which may appear unsightly on a store shelf. Lastly, the upper edges of the display tray panels are not secured to any of the corresponding panels of the cover portion, meaning that the upper edges of the tray may be torn or damaged when the cartons are stacked for shipping if an adjacent carton catches on any of these unsecured tray edges.

A very similar carton to the Pareike carton ('993) is described by Laduranty in FR2713597. In this carton, tabs on each side of the carton are broken to separate the upper cover portion from the tray portion. Breaking of these tabs will leave unattractive tears on each side of the display tray.

U.S. Pat. No. 5,842,576 (Snow) claims a shipping/display carton formed from a single blank that is convertible to a display tray by simply lifting off the cover. However, there is nothing securing the front panel of the cover (the panel with the hand grip aperture) to the display tray portion, and it is presumed that tape or adhesive will be necessary to secure the front of the carton for shipping.

U.S. Pat. No. 6,510,982 (White, et al.) claims a shipper/display carton formed from a single blank that has weakened areas (i.e. perforation lines) running around each of the front, sides, and back panels. Although an aperture is provided for grasping the upper portion of the carton to tear it away, there must be some difficulty in breaking the carton along these long perforation lines.

U.S. Pat. Nos. 6,974,033 and 7,066,379 (McLeod, et al.) claim rugged shipper/display cartons, each formed from at least two separate blanks. The cartons include perforated lines around the cover portion such that the cover can be separated from the tray. However, each blank must first be separately erected, and then the cover telescoped into the tray with concomitant gluing.

Other examples of shipper/display cartons formed from single blanks that include either tear-strips and/or perforated lines are described in U.S. Pat. Nos. 7,175,066 and U.S Pat. No. 7,628,746 (Varanasi); U.S. Pat. No. 7,410,062 (Monk); U.S. Pat. No. 7,451,878 (Rochefort, et al.); and, U.S. Pat. No. 7,478,745 (Philips).

Perusal of the prior art shows that further improvements in the design of shipper/display cartons are warranted. The balance between strength, cost, ease of die-cutting the blank(s), ease in erecting the carton, and ease of opening the shipper/display carton at the point-of-purchase has not been achieved, in spite of decades of innovation in this area of packaging. Tear-strips have the clear disadvantage of leaving rough, unattractive edges on the display tray. Hiding the tear strips as two short strips behind access cutouts results in inadequate securing of the cover portion to the tray portion of the carton, in addition to unattractive tray panels. Nesting of separately erected tray and cover blanks in order to form cartons of improved shipping strength require gluing at the bottom edges of the covers and subsequent difficulty in separating the cover. Cartons with minimal attachment points between the cover and tray panels result in loose/bowed-out tray panels that may be torn or dented by adjacent cartons. Lastly, cartons with long perforation lines that run completely around the circumference of the carton invite cutting the use of a knife, and that may lead to damage of the product packages within the shipping carton.

SUMMARY OF THE INVENTION

The present invention is a new and novel shipping/display carton formed from two blanks that has the advantages of shipping strength, ease of erection and gluing, and ease in breaking apart to an attractive and undamaged display tray for the retail store shelf.

In accordance with an exemplary embodiment of the present invention, a shipping/display carton is comprised of a cover portion formed from a cover blank and a tray portion formed from a tray blank. The blanks are preferably glued together at only three glue points when the blanks are stacked flat on each other and properly aligned. The fully erected carton may be easily broken apart into an attractive display tray and a disposable/recyclable cover by gripping the cover within a hand-grasping aperture and lifting the cover portion up to break the carton apart at only three short perforation lines (two side tabs and along the rear of the carton).

In accordance with another exemplary embodiment of the present invention, the length of the perforated segments on each side panel comprise from about 20% to about 30% of the total length of each of the side panels of the carton. Ideally these two short perforated segments, one on each side panel of the carton, are staggered in location from the front panel of the carton such that the two perforated segments are broken sequentially rather than simultaneously when separating the carton. The short length of the perforated segments on the side panels, combined with their staggered locations, make separation of the cover portion from the tray portion much easier than in cartons seen in the prior art and in the market.

BRIEF DESCRIPTION OF THE DRAWINGS

The subject invention will hereinafter be described in conjunction with the appended drawing figures, wherein like numerals denote like elements to the extent possible, and wherein.

DETAILED DESCRIPTION OF THE INVENTION

Figure 1:
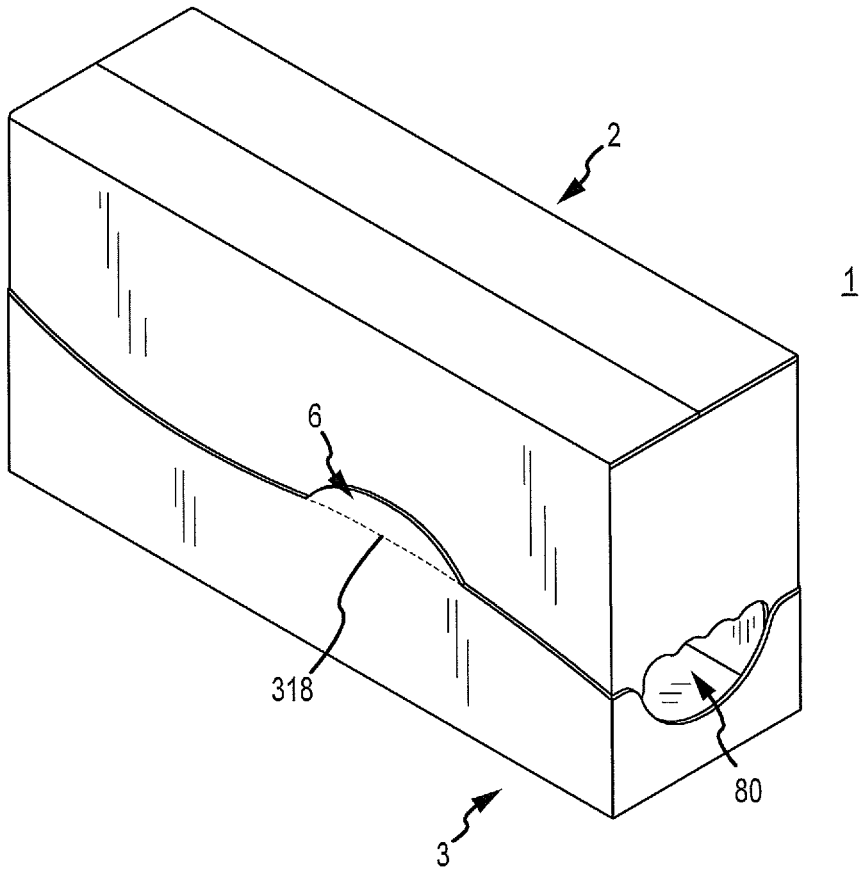
FIG. 1 is a front perspective view of the shipping and display carton of the present invention, in the fully erected and fully closed configuration for shipping.

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims. For example, the present carton may close at the top and bottom by other configurations of glued/stapled flaps besides the conventional arrangement of four flaps on each of the top and bottom. Additionally, though described herein in general terms of a shipping/display carton assembled from two separate blanks, additional cardboard, paperboard or corrugate board inserts or layers such as dividers or strengtheners may be envisioned in or on the present carton. Most importantly, the present shipping/display carton is not limited to a particular size or shape. It may be tiny, such as to ship and display items for sale at a checkout isle, or it may be huge, such as to ship and display large items for sale, for example ready-to-assemble furniture in separate stacked boxes. It is preferably cuboid or box-like, meaning entirely cubic or of a general rectangular shape, but may also be the shape of any polyhedron. "Box" and "carton" are used interchangeably and refer to a general cuboid structure having a top, bottom, sides, front, and rear that collectively enclose and protect an interior volume usable for packing, storing, shipping, and displaying product.

The spatial orientation used herein is such that the front of the fully erected shipping/display carton of the present invention refers to the panel facing the store clerk and that side that will face the consumers when only the tray portion is on the store shelf, and in an exemplary embodiment includes an aperture for grasping and breaking apart the carton. That is, the stock clerk in a store faces the front of the shipping/display carton when looking at the grasping aperture on the front panel. The "bottom" of the present carton refers to the bottom panel of the display tray portion of the carton, where such bottom will be in contact with some stationary surface for most of the life of the carton, such as a warehouse floor, a truck bed, a pallet, a forklift, a store shelf, or the like. Correspondingly, the "top" of the present carton refers to the uppermost panel of the cover portion of the carton. "Rear" and "back" may be used interchangeably to refer to that panel of the box that is the furthest from the viewer and not visible since it is behind the visible portions of the box. "Panel" and "flap" are meant interchangeably as primarily flat, rigid, structural elements that are mutually contiguous and collectively form the cuboid structure of the box, although where possible, panel refers to a larger and substantially visible portion of the carton and flap (or "glue flap") to a smaller functional portion such as a narrow glue flap that will likely not be visible from the exterior of the carton once erected. A side (or "top" or "bottom", etc.) to an erected box may be comprised of multiple separate panels and/or flaps (meaning that visible and completed side may be overlapping layers of panels and flaps). For example, two longer panels and two shorter end flaps may be folded up and glued or stapled to one another to create the "top" panel of an erected box. In a cube structure, four identical panels/flaps may be folded up and stapled, glued and/or taped to form either a "top panel" or a "bottom panel" to a carton. "Rear" refers to the panel opposite the panel with the grasping aperture, and the rear of an exemplary embodiment of the present carton preferably includes a horizontal perforated line running across the entire width of that panel. The "cover" refers to the disposable/recyclable portion of the shipping/display carton that is torn off from the lower tray portion. The "display portion", or "tray," or "display tray" refers to the bottom/lower portion of the shipping/display carton that is placed on the store shelf once the cover portion is torn away to display and market the individual product for sale. It is normally printed with graphics to identify and promote the sale of the product displayed at the retail level. Obviously the tray portion will be later discarded or recycled once the product is sold out from the in-store display.

The nature of the product that may be packed, stored and shipped within, and later displayed from, the shipping/display carton of the present invention are immaterial to the scope of the present invention. Product may be in the form of multiple smaller boxes, gusseted pouches, cans, bags, bottles, jars, envelopes, filled sleeves, small wrapped items (e.g. candy bars and chewing gum) or some other product form that is suitable for organization within the present shipping/display box. For example, a stack of product pouches may be lined up in one or more neat rows and/or in one or more vertical stacks within the shipping/display carton.

"Point-of-purchase" used herein refers to the physical location where a shipping/display carton such as the present invention is broken down into a disposable/recyclable cover portion and a display tray. This location is usually a retail store where the display tray containing the neat row or stack of product to be sold may be placed on the retail shelf. Examples of "point-of-purchase" include a supermarket, a drug store, a warehouse club store, or a do-it-yourself home center. The person breaking apart such cartons claimed herein may be a shipping clerk or a store clerk in the retail store charged with the responsibility of stocking the store shelves with product to be displayed for sale.

The term "blank" used herein is a term of art in the packaging industry that refers to a flat board/sheet that is cut to a pattern that may be erected into a carton structure. A "blank" may be a flat piece of corrugated board that has various cut lines and fold lines such that a machine (called a conversion machine or a carton erector) can build it into a 3-dimensional box. Such blanks may also be cut with perforated lines that may outline locations where the erected box can be opened at a future time. Perforated lines may allow removal of a flap, the opening of a handle or grasping aperture, or may outline a removable panel for access to the contents of the box when the panel is removed. Alternatively, perforations may outline entire sections of a box intended to be fully removed at some point, and may even run the length of the blank (and hence, circumscribe the entire erected box) so that the entire box can be separated into portions along that perforated line. Perforations in general allow for the ripping, tearing or breaking of the corrugated board along the line that is comprised of perforations. Perforations may be small notches, small cuts, or holes, or combinations thereof, and may be pierced or cut through one side or both sides of the corrugated board. For example, a perforated line that may be torn may comprise a series of small linear cuts lined up end to end with a particular spacing between the cuts.

Blanks represent a convenient and collapsed form of a box that may be stacked, bundled and shipped to the manufacturer of the product that is to be placed therein for storing, shipping and merchandising. A die-cut machine cuts cardboard or corrugated board into a blank that has a pattern such that the manufacturer can fold it up and glue it into the box shape, readying it for filling with product. Such processes and machines used for cutting, scoring and perforating cardboard and corrugate board into intricate blanks for box construction is amply disclosed in U.S. Pat. No.: 2,195,819 (Kurtzeborn); U.S. Pat. No. 2,313,801 (Corn); U.S. Pat. No. 2,390,072 (Beaton); U.S. Pat. No. 2,821,871 (Sarno); U.S. Pat. No. 2,860,555 (Williamson); U.S. Pat. No. 2,939,358 (Pearson); U.S. Pat. No. 3,020,809 (Guyer); U.S. Pat. No. 3,142,233 (Downie); U.S. Pat. No. 3,170,342 (Downie); U.S. Pat. No. 3,292,513 (Palmer); U.S. Pat. No. 3,485,146 (Sarka); U.S. Pat. No. 3,786,732 (Forbes); U.S. Pat. No. 3,869,949 (Dolle); U.S. Pat. No. 3,929,059 (Gendro); U.S. Pat. No. 3,982,458 (Terasake); U.S. Pat. No. 5,140,872 (Holliday); and, U.S. Pat. No. 6,203,482 (Sandford), each of which are incorporated herein in their entireties.

In regards to the materials of construction, the box of the present invention may be constructed of various paperboard, cardboard, corrugated board, sheet metal, or wood paneling, or combinations of these materials, with corrugated board being preferred. The blanks that will be described below are preferably manufactured from single wall corrugated board. Such corrugated board may be constructed by sandwiching and gluing fluted corrugating medium between layers of white, mottled-white or brown paper liner or paperboard. The choice of white, mottled-white, or brown paper for the corrugated board depends on what portion of the carton the corrugated board is to be used for. The present carton may be constructed of post-consumer waste/recycled materials or new materials as desired, with varying thicknesses depending on cost, desired weight and strength, balanced with environmental responsibility. Importantly, each of the two portions of the shipping/display carton, (i.e. cover and tray), need not be constructed of the same weight, thickness or even the same type of corrugated board, or even the same color of paper liner. In fact, in a preferred exemplary embodiment of the present carton, the two portions of the carton are formed from blanks having different corrugated board thicknesses and different color.

Affixation refers to the attachment of flaps and panels to one another for the purpose of securing together flat blanks, partially erecting flat blanks into open box-like structures, and erecting of the final carton. Affixation and "gluing" are used interchangeably herein, but it must be understood that throughout the packaging industry cartons may be secured by glue, staples, or tape, or combinations thereof. In this regard, where "glue" or "gluing" is stated herein, other substitute/additional means of affixing flaps and panels to one another, (such as stapling and taping), is within the scope of the invention. Likewise a "glue flap" may be secured to another panel by staples or tape rather than glue.

That being said, an exemplary embodiment of the shipping/display carton of the present invention, where the carton is convertible to a display tray and has a top, bottom, first side, second side, front end, and rear end when fully erected, minimally comprises; (1) a cover portion formed from a first blank herein also referred to as the "cover blank," said first blank comprising in combination; (a) a glue flap; (b) a first side panel; (c) a front panel preferably including a curvature that outlines the upper portion of a grasping aperture; (d) a second side panel; (e) a rear panel further including a single perforated line across which a portion of said rear panel may be fully separated from the cover blank; and, (f) top panels integrally connected to one or more of the first and second side panels, front panel, and rear panel for closing the top of the shipping/display carton; and, (2) a tray portion formed from a second blank herein also referred to as the "tray blank," said second blank comprising in combination; (a) a glue flap; (b) a first side panel further including a first glue tab for gluing to said first side panel of the cover blank, said first tab detachable from said tray blank by a perforated line; (c) a front panel further including a curvature that outlines the lower portion of a grasping aperture; (d) a second side panel including a second glue tab for gluing to said second side panel of the cover blank, said second tab detachable from said tray blank by a perforated line; (e) a rear panel; and, (f) bottom panels integrally connected to one or more of the first and second side panels, front panel, and rear panel for closing up the bottom of the shipping/display carton.

In another exemplary embodiment of the present invention, the side tabs make up only from about 5% to 45% and more preferably from about 20% to about 30% of the total length of the side panel of the carton.

In another exemplary embodiment of the shipping/display carton of the present invention, the glue flap present on the cover blank may further include a locator aperture that may be used to properly align the two flat blanks for gluing them together in alignment.

In another exemplary embodiment the two blanks are preferably glued together at only three locations; (1) the first tab of the tray blank to the first side panel of the cover blank; (2) the second tab of the tray blank to the second side panel of the cover blank; and (3) the rear panel of the tray blank to the detachable portion of the rear panel of the cover blank.

In another exemplary embodiment the curvature present on the front panel of the cover portion further includes a series of undulating curves that make up four (4) finger recesses so that the store clerk may grasp the cover portion more comfortably to break the present carton apart into a cover portion and a display tray.

In another exemplary embodiment of the present carton, breaking apart the shipping/display carton into separate cover and tray portions results in the breaking of the each of the two tabs from their respective tray side panels and the breaking away of the detachable portion of the rear panel from the cover blank. After separation of the carton portions, the two tabs remain glued to their respective side panels of the cover blank, and the detachable portion of the rear panel of the cover blank remains glued to the rear panel of the tray blank. The breaking apart of the carton into separate cover and tray portions is facilitated though the gripping of the cover portion within the grasping aperture preferably provided in the front of the carton by combination of curvatures present on the front panels of the cover blank and tray blank.

In another exemplary embodiment of the shipping/display carton of the present invention, the distance that the first tab on the first side panel of the tray blank is spaced from the front panel of the tray blank is different from the distance that the second tab on the second side panel of the tray blank is spaced from the front panel of the tray blank. This "staggered" location of the glue tabs allows for sequential breaking of the perforated lines that hold the tabs to the tray blank.

In another exemplary embodiment of the shipping/display carton of the present invention, the erected carton comprises a cover portion that substantially telescopes within a tray portion such that the two side panels and the rear panel of the completely erected carton are essentially double thickness corrugated board (overlapping separate single wall corrugated board). In this way, a thicker corrugated board preferably used for the cover blank may reinforce and strengthen thinner corrugated board preferably used for the tray blank at the sides and the rear of the carton.

These general comments and preferred embodiments are more easily understood through a discussion of the drawing figures and the numbered elements therein.

FIG. 1 is a front perspective view of an exemplary embodiment of the shipping/display carton of the present invention when said carton is fully erected. The carton 1 is comprised of a cover portion 2 telescoped within and affixed to a tray portion 3 at several glue points. As will be described below in detail, cover portion 2 and tray portion 3 are formed from separate blanks, preferably die-cut from corrugated boards. The blanks may be laid flat on top of each other with their printed sides up, lined up and glued at selected points, and then the entire carton may be folded up and glued to give rise to the illustrated box. Alternatively, each blank may first be partially erected into rectangular open box-like structures, and then the two blanks telescoped within each other with concomitant gluing at selected points. Ideally the carton 1 is a "collapsible carton," meaning that fully printed, die-cut and glued blanks may be kept flat, bundled and stacked in a manufacturing plant until needed, even when the collapsed and ready to erect shipping/display carton is comprised of two flat blanks previously glued together (a two-layered blank), such as preferred here.

As shown in FIG. 1, one attachment/glue point between cover portion 2 and tray portion 3 is first tab 6 that is an integral portion of tray portion 3, glued to the first side panel of the cover portion 2. A grasping aperture 80 is also a preferred feature of the present carton 1. Grasping the cover portion 2 by gripping within this aperture allows the clerk to pull up on the cover 2 to break it away from the tray portion 3. Amongst other perforations that give way in opening the carton, perforation line 318 breaks when the cover is pulled up, leaving first tab 6 still attached to cover 2 to which it was originally glued.

The present carton 1 shown in FIG. 1 may be of any size depending on the nature of the product packages stored, shipped, and finally displayed at the point-of-purchase for consumers. For example, the carton 1 may be configured in size to hold a stack of music CDs, a row of chewing gum packages, lines of shampoo bottles, detergent bottles, or even stacks of ready-to-assemble bookcases boxed in their own separate flat boxes. With that in mind, the carton 1 may be as small as 6 inches L×3 inches W×4 inches H, or may be as large as 6 feet L×3 feet W×4 feet H. For typical consumer retail, the carton 1 is preferably about 12 inches L×6 inches W×8 inches H such that the tray portion 3 will fit the width of supermarket/drugstore shelves to display smaller consumer items for purchase (household cleaners, laundry detergents, personal hygiene/care items, etc.). The weight and strength of the present carton 1 may be adjusted to accommodate the weight and number of product items stored, shipped and merchandized therein, and to accommodate the anticipated layers of cartons 1 stacked on a pallet without crushing the lowest layer of cartons. The weight and strength of the carton 1 may be adjusted by the choice of corrugated medium used for the two blanks, and if necessary the carton 1 may be constructed of something stronger than single wall corrugate board, such as double wall, triple wall, or even thicker corrugated board.

Figure 2:
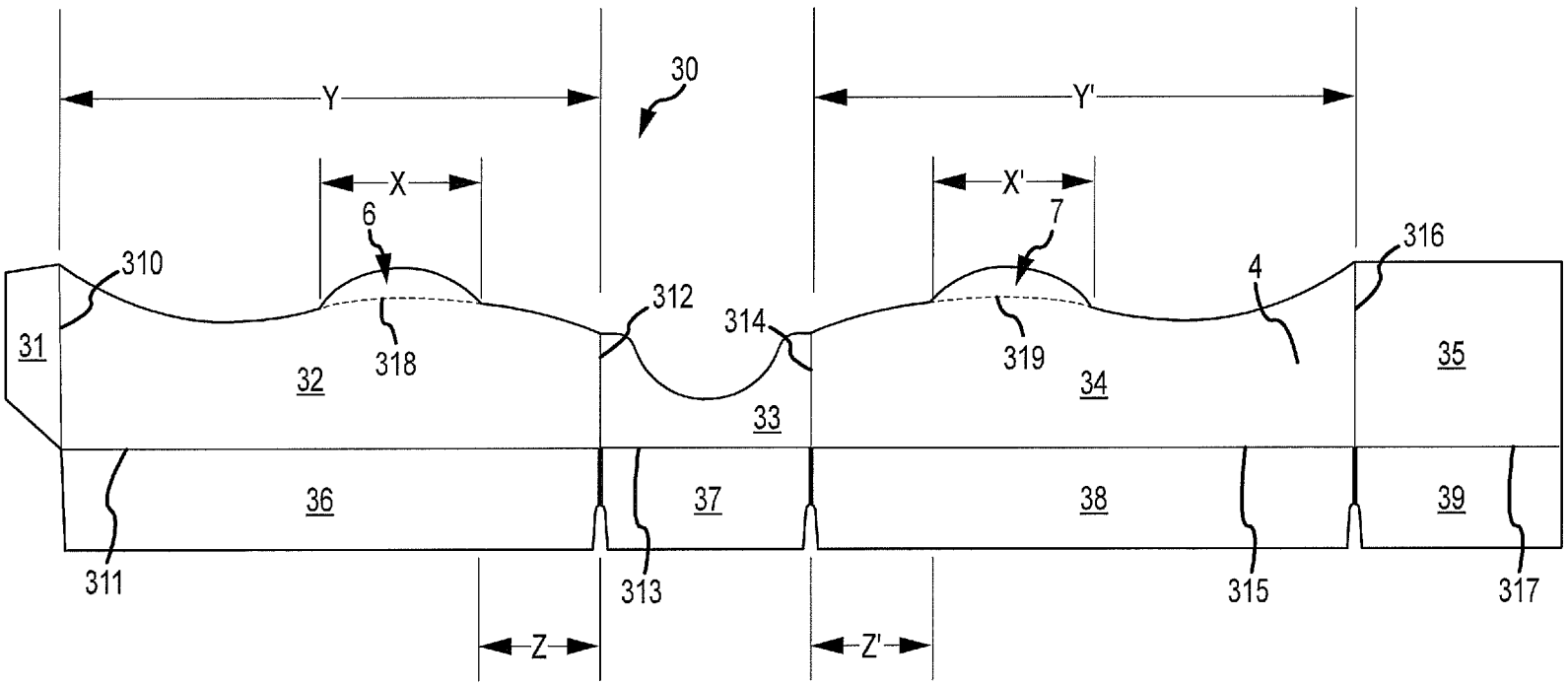
FIG. 2 is a plan view of an embodiment of a second blank from which the tray portion of the present shipping and display carton is formed.

FIG. 2 depicts a plan view of a preferred embodiment of a tray blank 30 which forms the tray portion 3 in accordance with the present invention. The tray blank is also referred to as the "second blank" for consistency of nomenclature herein. Tray blank 30 has an outer surface 4 when viewed flat as shown that may be preprinted with product branding or other identifying and promotional information, and an inner surface 5 (not shown because it is underneath when the blank is laid flat as in the drawing figure). The tray blank 30 comprises nine (9) distinguishable and contiguous panels and flaps (elements 31-39), each having at least one (1) hinging line/crease (elements 310-317) across which each panel can be bent to an angle of 90° from the panel it is attached and/or adjacent to, and two distinguishable tabs. Hinging lines 310-317 are identified in FIG. 2 by thin solid lines whereas cut lines (where the panels are physically separated in part by a cutting during the die-cut operation that forms the blank, and including the outer boundary of the blank) are identified by heavy solid lines. Perforated lines are identified by short dashes or notching along a straight and linear direction. More specifically, the tray blank 30 comprises first and second side panels 32 and 34 that are the first and second side panels respectively of the tray when the tray blank is erected. Panel 33 is the front end panel and that panel preferably comprises a second curvature in a concave shape on the upper edge of that panel that forms the lower portion of a grasping aperture in the completed shipping/display carton. Panel 35 is the rear panel of the tray. Panels 36, 37, 38, and 39, form the bottom of the tray when the tray blank is erected into a tray and that together form the bottom of the erected shipping/display carton. Lastly, panel 31 is a glue flap that may be glued or permanently fixed through any other affixation method (staples, etc.) to panel 35. When glue flap 31 is brought around and glued to panel 35, with concomitant bending of hinge lines 310, 312, 314, and 316, a substantially rectangular structure is formed having two sides and rear and front ends. However, there is no top panel enclosing the structure since it is a tray: Also, a bottom to this tray is not formed until panels/flaps 36-39 are folded up and glued in accordance with the present invention. This latter folding and gluing of bottom flaps 36-39 is normally not performed until the shipping/display carton is ready for loading with the individual product units to be merchandised (explained below). Flaps such as these may be any size, although typically for conventional boxes there are two short end flaps and two longer side flaps, wherein the short end flaps 37 and 39 are traditionally folded in first, followed by longer flaps 36 and 38 that are glued to 37 and 39 and then taped along the seam where 36 and 38 meet. It should be noted that the tray blank 30 as shown in FIG. 2 is symmetrical across a vertical axis drawn through the middle of panels 33 and 37, ignoring panels 31, 35, and 39. Meaning that if there is no graphic artwork preprinted on either side of the blank, it would not matter if flap 31 was glued from its outer surface onto the inner surface of flap 35, or if the inner surface of flap 31 was brought around and glued to the outer surface of flap 35. In the preferred embodiment, the tray blank 30 is preprinted with artwork on one side and therefore it is only logical to wrap the blank around to form the rectangular tray structure in the direction that results in the artwork being visible on the outside of the completed carton. For clarity, the "inner" surface of the blank refers to the surface internal to the completed shipping/display carton and that surface is not typically preprinted with artwork. Consequently, the "outer" surface of the blank is the surface external to the completed tray and is preferably preprinted with graphics. Alternatively, both surfaces of blank 30 may be preprinted if there is occasion to see the inner surfaces of panels 32, 33, and 34 when the tray is on a retailer's shelf displaying product for sale.

Still referring to FIG. 2, tray blank 30 includes at least two tabs 6 and 7 that are preferably glued to the cover portion in the finished carton. First tab 6 is integrally connected to first side panel 32 by a weakened segment 318 formed by perforations along a line that can be broken by the stock clerk when he/she separates the cover portion from the tray portion at the point-of-purchase. Similarly, second tab 7 is attached to second side panel 34 by a similar perforated line 319. As explained below in detail, the inner surfaces of tabs 6 and 7 (the side opposite the preprinted outer surface 4 of blank 30) are preferably glued to the side panels of the cover portion of the carton, for example near the middle of each panel. When the cover is torn away at point-of-purchase, tabs 6 and 7 break away from the tray portion and remain glued to the side panels of the cover. The salient feature of the present invention is that the perforated segments 318 and 319 comprise only a portion of the total length of the side panels of the completed carton. The prior art is inundated with examples of shipping/display cartons that have perforation lines that run the entire length of the side panels of the carton that require enormous effort to break, or that at the very least invite the use of a cutting instrument. In a preferred configuration of the present invention however, the length of the perforated line 318 is only from about 5% to about 45% of the total length of the side panel 32 of the tray. "Length" used herein refers to that dimension of the side panel measured along the side panel from the front to the rear of the carton and is synonymous with the "depth" of the display tray on a store shelf. Most preferred is that this weakened and breakable line 318 comprise only from about 20% to about 30% of the length of the panel 32. More precisely, and still with reference to FIG. 2, the ratio of lengths X/Y should be from about 0.05 to about 0.45, and most preferably from about 0.20 to about 0.30. Similarly and now referring to the second side panel 34, the ratio of lengths X'/Y' should be from about 0.05 to about 0.45, and most preferably from about 0.20 to about 0.30. This is essential so that the store clerk need not rip down the entire length of each side of the carton in order to separate the cover and tray portions. Notably, tabs 6 and 7 are an integral part of the overall tray blank 30. The entire blank is preferably cut from a single piece of corrugated board. The perforations that give rise to the weakened segments 318 and 319 are cut into the corrugated board at the time of the die-cutting of the blank 30 with various blades and processes as described in the above references.

The shapes of the tabs 6 and 7 need not be semicircular as shown in the exemplary embodiment in the drawing figures. It is within the scope of the present invention for tabs 6 and 7 to be any other shape, such as square or rectangular, and the two tabs need not be the same identical shape. The tabs may provide decorative as well as functional aspects and can be shaped to integrate into curved top edges of the tray portion as illustrated, giving rise to a slight curvature to the perforated lines 318 and 319. Functionally however, it is preferred that the tabs 6 and 7 be of sufficient size to allow secure gluing of the tray portion to the side panels of the cover portion in the present shipping/display carton, regardless of the decorative shape chosen for the tabs. For example, tabs 6 and 7 each having about 1.5 to about 3 square inches ($in^2$) of area give an adequate surface area for gluing. The present carton is not constrained by the number of such tabs present on each side of the tray blank, although only two, one on each side panel, is the most preferred embodiment and is illustrated throughout the drawing figures. It is preferred that each side panel of the tray include at least one tab, however only one tab on each side is the most preferred configuration.

Importantly, it is preferred that the tray blank 30 not be symmetrical when viewed across a vertical axis drawn through panel 33 and ignoring panels 31, 35, and 39. It is more preferred to "stagger" the location of tabs 6 and 7 on panels 32 and 34 such that the breaking of the tabs from the tray portion when the cover is pulled away from the tray occurs sequentially and not simultaneously. More precisely, and with reference still to FIG. 2, distance Z is preferably not identical to distance Z'. When Z does not equal Z', the two tabs 6 and 7 break away from the tray portion across their perforated lines 318 and 319 at different times, meaning that less force is required for separation of the carton into the display tray and cover portion. The location of tabs 6 and 7 relative to the tray side panels 32 and 34 may be such that the start of the breaking of one tab just precedes the start of the breaking of the other in time, or the tabs may be so staggered in position that one tab breaks away entirely before the other tab even begins to break away. For example, and to illustrate the preferred embodiments, if distance Z' is greater than the sum of Z and X, tab 6 will tear away from panel 32 before tab 7 even begins to break apart during the opening of the carton. Alternatively, if Z' is greater than Z but less than the sum of Z and X, tab 6 will begin breaking first, followed shortly thereafter by the start of the breaking away of tab 7. This staggered start to the breaking process of the tabs may result in either the tabs finishing the breaking process at different times or at the same time, recognizing that distance X does not necessarily need to be the same as distance X', (i.e. the lengths of the perforated connection lines 318 and 319 do not need to be the same). Of course, the force required to break along weakened segments 318 and 319 depends on the nature of the perforations that comprise these weakened lines, along with the length of these perforated lines, and whether 318 and 319 are broken simultaneously or sequentially as discussed above. For example, the depth and number of cuts/notches/holes that form the perforated lines 318 and 319 will influence the force required to tear through these segments. If the perforations are configured such that higher force is required to tear the perforations (fewer and/or shallow perforations and/or cuts/holes only through one side of the corrugated board), then it may be more preferred to stagger the location of the tabs so that the perforated lines 318 and 319 are torn sequentially. Conversely, if the perforations are configured such that mere weak force may tear them (numerous deep cut perforations, cuts through both sides of the corrugated board), then the tabs may be lined up symmetrically and torn through simultaneously.

Figure 3:
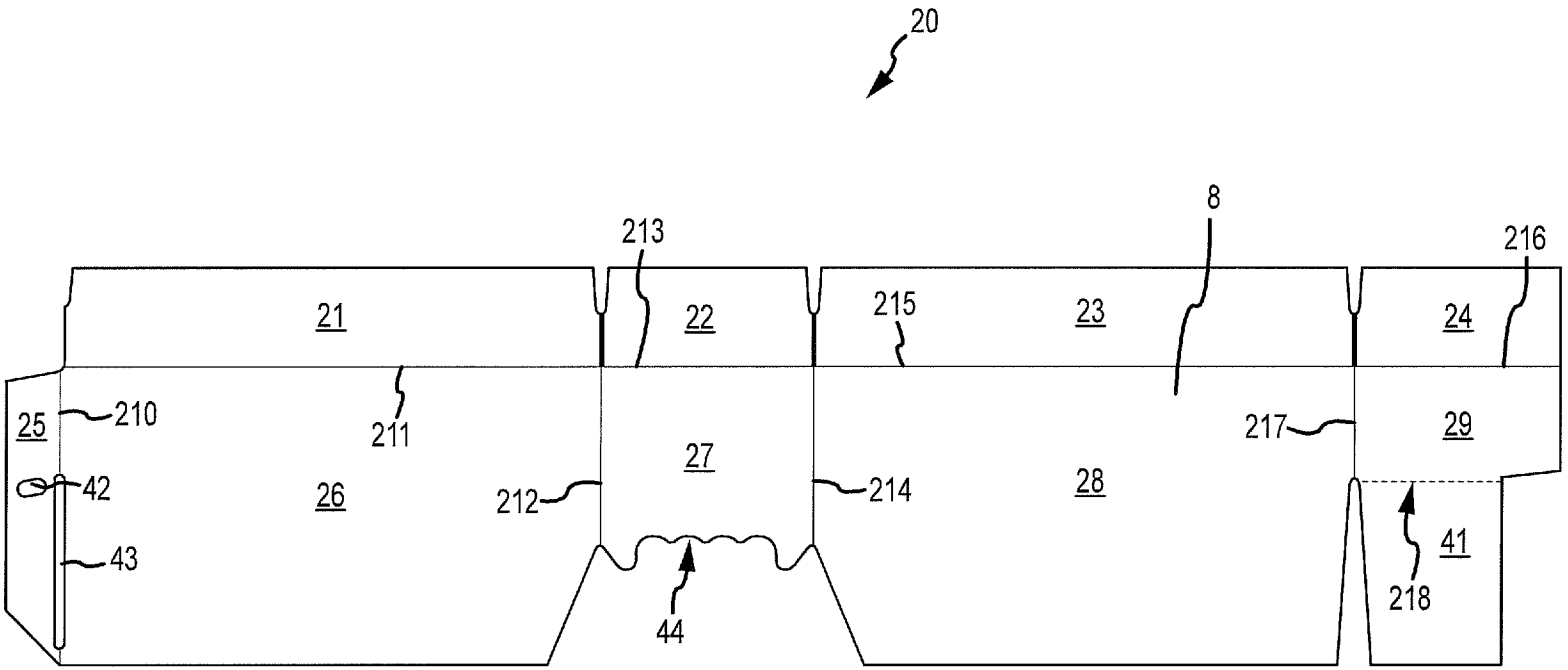
FIG. 3 is a plan view of an embodiment of a first blank from which the cover portion of the present shipping and display carton is formed.

FIG. 3 depicts a plan view of an exemplary embodiment of a cover blank 20 which forms the cover portion 2 in accordance with the present invention. The cover blank is also referred to as the "first blank" for consistency in the nomenclature herein. Cover blank 20 has an outer surface 8 when laid flat as shown, which may be preprinted with barcodes, pallet instructions or other information, and an inner surface 9 (not shown because it is underneath when the blank is laid flat as in the drawing figure). Preferably the cover blank 20 is constructed from corrugated board made with brown paper liner since this portion of the carton is torn away and discarded, and not seen by consumers at the retail level. The cover blank 20 further comprises ten (10) distinguishable and contiguous panels and flaps (elements 21-29 and 41), each having at least one (1) hinging line/crease (elements 210-217) across which each panel can be bent to an angle of 90° from the panel it is attached and/or adjacent to. Hinging lines 210-217 are identified in FIG. 3 by thin solid lines whereas cut lines (where the panels are physically separated in part by a cutting during the die-cut operation that forms the blank, and the outer periphery of the blank itself) are identified by heavier solid lines. Perforated lines are shown by dashed or notched lines. More specifically, the cover blank 20 comprises first and second side panels 26 and 28 that become the first and second side panels of the cover when the cover blank is erected. Panel 27 is the front end panel and that panel preferably includes a first curvature and most preferably a series of undulations forming four (4) finger recesses 44 that together form the upper portion of a grasping aperture in the competed shipping/display carton (80 in FIG. 1). Of course, actual finger contours are not required along this first curvature where the recesses 44 are cut, (the bottom edge of front panel 27), and a simple concave curve may adequately provide the upper portion of the aperture for grasping. Panels 29 and 41 together form the "two-portion rear panel" of the cover portion and are connected only by a perforated line 218 such that panel 41 may be fully separated from the cover blank by ripping along single perforated line 218. In other words, the rear panel to the cover blank preferably comprises two portions, an upper portion 29 that is fixed to the blank, and a lower, detachable portion 41. It is preferred that panel 41 not connect to the second side panel 28 of the cover blank, otherwise panel 41 cannot separate from the cover blank by the tearing of a single straight perforated line such as 218. Therefore, in the most preferred embodiment, the upper portion 29 of the rear panel of the cover blank is not detachable from the cover blank, whereas the lower portion 41 is fully detachable from the cover blank when tearing across the connecting perforations 218. This is important because the detachable portion 41 will remain glued to the tray when the final shipping/display carton is torn apart into cover and tray portions at point-of-purchase. Panels 21-24 form the top of the cover (and the top of the shipping/display carton) when the cover blank 20 is erected into a box-like structure and are folded up and glued and/or taped as any traditional carton top. Panel 23 may be wide enough to overlap the entire top of the carton, or may be only as narrow as panel 21. Lastly, panel 25 is a glue flap that may be glued or permanently fixed by staples to panel 29. Since the height of panel 29 is shorter than 25, only the upper portion of panel 25 (the top portion of 25 above aperture 42 as illustrated) need be coated with glue to affix 25 to panel 29. In other words, when flap 25 is glued to the rear panel of the blank, 25 is glued only to the non-detachable portion 29 and not to the removable portion 41 of the cover blank. Glue flap 25 may include an optional aperture 42 that functions both as a locating tool for aligning the blanks and an optional point of tearing (explained below). Additionally, elongated aperture 43 (essentially a "slot") may be included on the blank 20, preferably positioned along the fold line 210 between glue flap 25 and first side panel 26 of the cover blank 20. Incorporation of this elongated aperture 43 shortens the connection between flap 25 and panel 26 to essentially the portion of crease line 210 above locator aperture 42. Incorporation of both of these apertures 42 and 43 becomes useful if the lower portion of flap 25 (the portion below the aperture 42) is optionally (or accidentally) glued to the tray blank (explained below).

When glue flap 25 is brought around and glued to panel 29, with concomitant bending of hinge lines 210, 212, 214, and 217, a substantially rectangular structure is formed having two sides and rear and front ends. However, there is no bottom panel enclosing the structure since it is a cover for a display tray, and no top to the cover portion is formed until panels 21-24 are folded up and glued in accordance with the present invention. This latter folding and gluing of top flaps 21-24 is normally not performed until the shipping/display carton is ready for loading with the individual product units to be merchandised (explained below). It should be noted that flap 25 may be glued from its outer surface onto the inner surface of flap 29, or alternatively, the inner surface of flap 25 may be brought around and affixed to the outer surface of flap 29. In the preferred embodiment, the cover blank 20 is preprinted with a barcode, product information, and instructions for opening the carton on only one side of the corrugated board blank, and therefore it is only logical to wrap the blank around to form the rectangular cover structure in the direction that results in this printing being visible on the outside of the completed carton. For clarity, the "inner" surface of the blank and the completed cover structure is the surface internal to the completed carton and is preferably not preprinted with graphics. Consequently, the "outer" surface of the blank and the completed cover structure is the surface external to the carton and is preferably preprinted with graphics. In the final carton, and provided that both the tray blank and cover blank are partially erected first and then nested together, it is irrelevant whether panel 41 of the cover structure ends up directly overtop of panel 31 of the tray or not.

However, it is most preferred that the tray blank 30 and cover blank 20 be lined up and glued together while they are both still flat, with the tray blank 30 laid on top of the cover blank 20, without either blank even partially erected. The reason for this preferred order of assembly is that it is too difficult to nest the partially erected tray and partially erected cover blanks together while simultaneously gluing the inner surfaces of tabs 6 and 7 to the outer surfaces of panels 26 and 28 without smearing the glue during the nesting process. In the preferred process of gluing the flat blanks together first, the optional locator aperture 42 on the cover blank 20 may be used to line up the top edge of flap 31 on the tray blank 30. Additionally, the side panels 26 and 28 of the cover are aligned at the bottom of panels 32 and 34 of the tray blank.

That is, the bottom edges of panels 26 and 28 (the cut edges without fold lines) are lined up along tray blank fold lines 311 and 315. The upper edge of panel 35 will necessarily line up with the perforated line 218. When gluing the two flattened blanks together, glue is applied only to the inner surfaces of tabs 6 and 7 and panel 35 (or alternatively, glue may be applied to the outer surface of panel 41 instead of the inner surface of panel 35). Through this process of gluing at three points, first tab 6 will be glued to first side panel 26, second tab 7 will be glued to second side panel 28, and panels 35 and 41 will be glued together. This process of gluing the two flat blanks together creates a new two-layered blank that may be later erected into the carton 1. Preferably, flap 31 is not glued to 25 when the two blanks are glued together in their flat states, although doing so is not deleterious to construction of the shipping/display carton or its later separation into tray and cover portions at point-of-purchase provided optional apertures 42 and 43 are included on the cover blank. For example, the inner surface of flap 31 may be glued to the outer surface of flap 25 on that portion of 25 that resides below the aperture 42, (the only portion of 25 that flap 31 will overlap when the two blanks are properly aligned). When the carton is put to use and the cover portion broken away from the tray portion, the apertures 42 and 43 form additional points of breaking, as though they are each a large, single perforation. In this way, the lower portion of glue flap 25 (if previously glued to flap 31 when the flat blanks were aligned and glued) will remain glued to the tray portion and will detach and stay with the tray (along with panel 41) when the carton is torn apart at point-of-purchase. However, in the most preferred configuration where 25 is not glued at all to 31 when the flat blanks are aligned and glued, segments 318, 319 and 218 are the only perforated lines that break apart when the cover portion is separated from the tray portion. As explained, it is acceptable that panel 25 rupture across apertures 42 and 43 if panel 25 was purposely or even accidentally glued to flap 31 when the two flat blanks were aligned and glued together.

Figure 4:
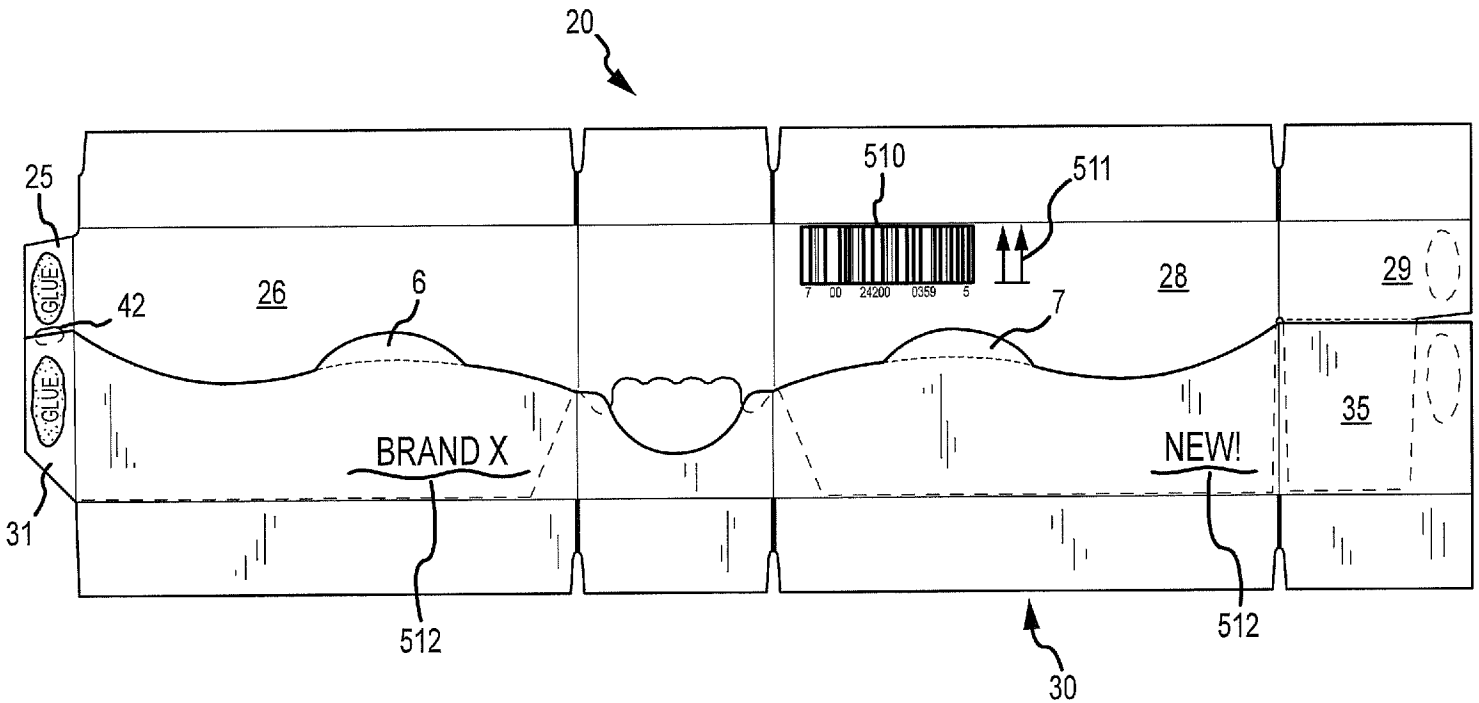
FIG. 4 is a plan view of an embodiment of a two-layer blank formed from the affixation of the tray blank onto the cover blank.

FIG. 4 shows a preferred exemplary embodiment of the two-layer blank structure that results when the tray blank 30 is glued to the cover blank 20. The dashed lines drawn with long dashes represent the portions of the outline of the cover blank 20 that are obscured from view, behind the overlaid tray blank 30. The tray blank 30 is preferably laid on top of the cover blank 20 with their printed sides both up and visible as shown. As explained above, the tray blank 30 is preferably laid on top and affixed to the cover blank 20 at three, and optionally four, attachment points. These preferred glue points include; (1) the inner surface of tab 6 to the outer surface of panel 26; (2) the inner surface of tab 7 to the outer surface of panel 28; (3) the inner surface of 35 onto the outer surface of detachable panel 41 (panel 41 is entirely underneath in the drawing, covered by tray blank 30); and optionally, (4) the inner surface of flap 31 to the outer surface and lower portion of flap 25, (flap 25 extends below flap 31, and the point where 31 is glued onto 25 is not visible in this plan view). As mentioned, the optional gluing of flap 25 to flap 31 to further secure the two-layered blank in manufacturing and storage should only be done if the apertures 42 and 43 are included on the cover blank. As illustrated in FIG. 4, both printed surfaces of each of the two blanks are visible on the same side of the two-layer blank (which forms the outer surfaces of the erected carton). For example, barcode 510 and pallet arrows 511 may be printed on the outer surface of the cover blank 20 as indicated. Additionally, product branding and other marketing information such as 512 may be printed on the outer surface of the tray blank 30. Tray blank 30 may be constructed of a white paper liner corrugated board whereas cover blank 20 may be constructed from ordinary brown paper liner corrugated board. This configuration is preferred because the cover portion is pulled off from the tray portion and the consumer is expected to see only the tray portion in the retail store.

Still referring to FIG. 4, the two-layered blank comprising the tray blank 30 and the cover blank 20 now glued together at select points, may then be glued end-to-end to form a rectangular box-like structure with open top and bottom, ready for loading with product to be shipped and merchandised. Preferably, this partially erected carton (formed by gluing the two-layered blank illustrated in FIG. 4 end-to-end) is a collapsible carton, meaning that it too can still remain flat until final carton erection. To that end, glue is preferably applied to the outer surfaces of both flaps 25 and 31 and then the two-layered blank is folded around on its crease lines such that the outer surface of flap 25 is affixed to the inner surface of panel 29 and the outer surface of flap 31 is affixed to the inner surface of panel 35. FIG. 4 illustrates the approximate areas that are preferably coated with glue in order to partially erect this two-layered structure (the word "glue" written in the oval circles in the drawing on flaps 25 and 31 represent the preferred locations for glue application, with the corresponding dashed oval circles on the underside of 29 and 35 representing attachment points). As with any carton erection, glue may be replaced or supplemented with tape, staples, rivets, or any other means of affixation, depending on the required strength of the finished carton and aesthetic considerations. Once flaps 25 and 31 are brought around and glued to the inner surfaces of panels 29 and 35 respectively, a rectangular box-like structure is created where the printing is on the external surfaces of the carton, and the carton is ready equipped with two sets of flaps for closing up the top and bottom after loading. As mentioned, this structure is preferably collapsible, and with appropriate choice of the width and weakness of crease lines, it may be configured to lay flat in spite of the double thickness for portions of some of the crease lines. Such a collapsed carton need only to be expanded three-dimensionally, loaded with product to be merchandised, and then closed up at the top and bottom like any conventional box.

Figure 5:
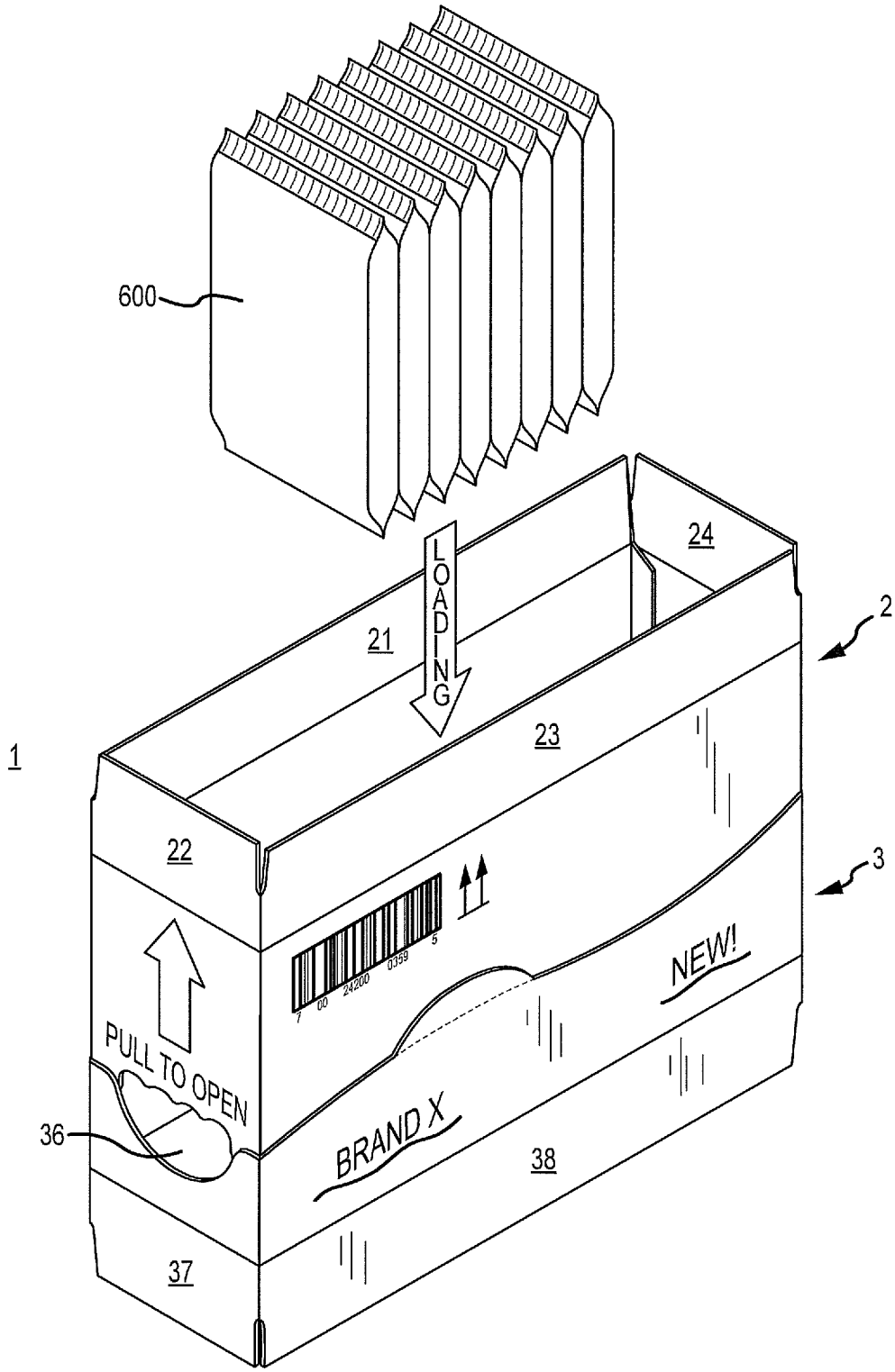
FIG. 5 is a front perspective view of an embodiment of the shipping and display carton of the present invention in the partially erected state in preparation for loading with product packages.

FIG. 5 shows a preferred exemplary embodiment of a partially erected shipping/display carton of the present invention ready for loading with stacks/rows of product packages. As described in detail above, the carton 1 of the present invention is comprised of a cover portion 2 and a display tray portion 3, each of which was preferably formed from its own separate corrugated board blank. The structure shown in FIG. 5 is a carton ready for loading, where the carton has a set of open top flaps (21-24) and open bottom flaps (36-38, with 39 not visible) usable for closing up the carton. Summarizing the discussion above, the shipping/display carton 1 may be formed from either of two routes: Method 1: partially erecting the tray portion 3 from tray blank 30 by gluing flap 31 to panel 35, partially erecting the cover portion 2 from cover blank 20 by gluing flap 25 to panel 29, and then telescoping the partially erected box-like cover portion inside the partially erected box-like tray portion and gluing tab 6 to panel 26, tab 7 to panel 28, and panels 41 and 35 together; or Method 2: laying the tray blank 30 print side up on top of the cover blank 20 also print side up and gluing the former to the latter at three locations (6 to 26, 7 to 28, and 35 to 41) and optionally at a fourth point (31 to 25 if additional stability is required), and then folding the two-layered blank around to attach flaps 25 and 31 to panels 29 and 35 respectively. As mentioned above, the latter route (Method 2) is preferred because trying to glue the tabs 6 and 7 to their respective cover side panels 26 and 28 while telescoping the partially erected cover blank into the partially erected tray blank is problematic.

Still referring to FIG. 5, the partially erected shipping/display carton 1 may be loaded with the individual product packages to be stored, shipped, warehoused, and ultimately merchandized. In a preferred method, partially erected carton 1 may be loaded with an organized row of product pouches 600 that may be present in a quantity that fits appropriately within the carton, which together form a merchandisable shipping unit of product. Depending on the manufacturer's carton erecting equipment and internal capabilities, the loading of product 600 may be up into the bottom of the carton rather than down into the top of the carton as illustrated in FIG. 5. The top flaps 21-24 may be glued/taped up prior to loading of product 600 up into the bottom of the carton, or alternatively, the bottom flaps 36-39 may be glued/taped up prior to loading of the product packages 600 down into the top of the carton.

Figure 6:
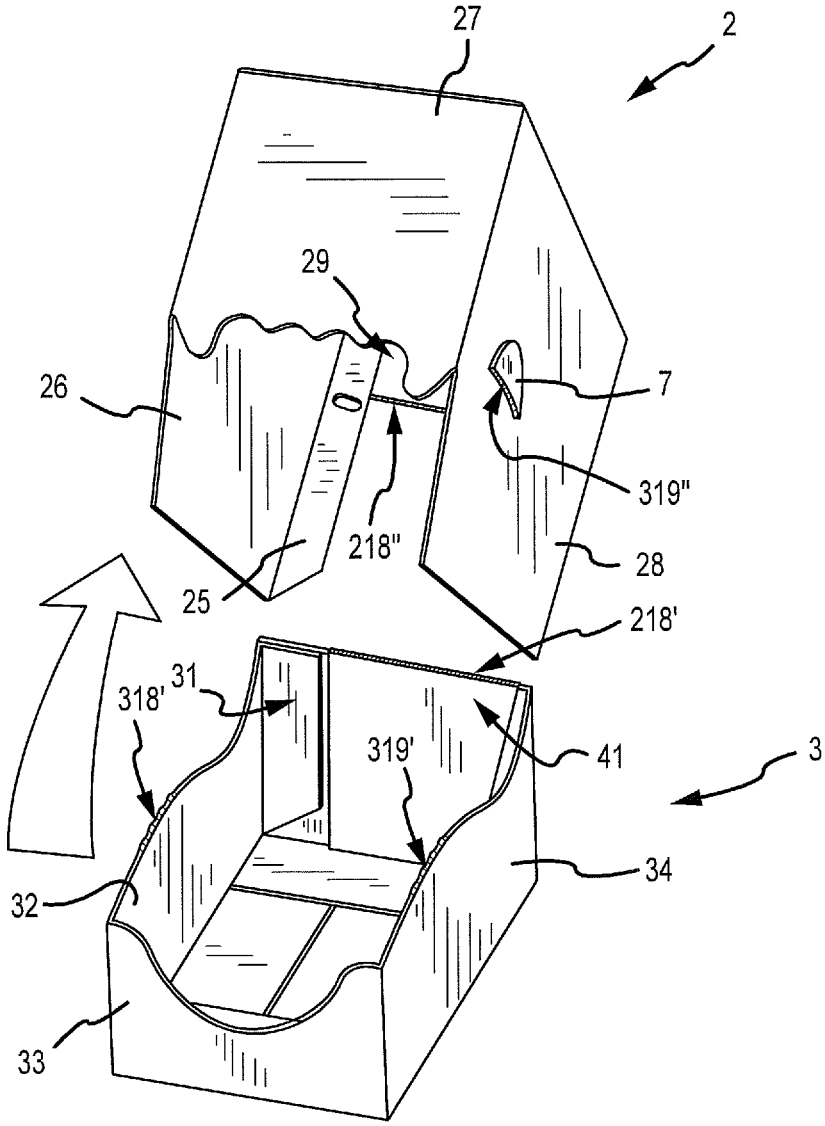
FIG. 6 is a front perspective view of an embodiment of the shipping and display carton of the present invention after the carton has been torn open into corresponding cover portion and display tray.

FIG. 6 illustrates an exemplary embodiment of the carton 1 of the present invention once the complete and erected carton has been broken apart into separate cover and display tray portions. The merchandized product (such as example 600 used in FIG. 5) has been left out of the figure so as not to obscure the inner flaps/panels of the tray portion. In actual use, there would preferably be product packages visible in the display tray once the carton is cracked apart. Referring now to FIG. 6, once the carton is cracked open in accordance with the present invention, (e.g. a store clerk gripping within the grasping aperture and tearing the cover off in the direction of the large arrow in the drawing figure), the carton will be physically separated into a disposable/recyclable cover portion 2 and a display tray 3. The tray portion 3 is seen to retain the now detached panel 41 glued into the rear of the display tray. As discussed above, panel 41 was originally part of the rear panel of the cover portion. In opening the carton, panel 41 detaches along perforation line 218 (best seen in FIG. 3). In the opened carton, perforated line 218 is shown split into rough edge 218" for the half of the perforated line remaining on cover panel 29, and 218' for the remainder of the perforated line 218 on panel 41 glued in the tray portion. Additionally the tray portion 3 will have two slightly roughened segments 318' and 319' appearing on the upper edges of the side panels 32 and 34 respectively that are the remains from the separation of the glue tabs 6 and 7 from the display tray when the carton is cracked open. These rough segments correspond in length to the original perforated lines 318 and 319 (best seen in FIGS. 2 and 4) and tend to blend in with the upper cut edge of the corrugated board of panels 32 and 34 and don't detract noticeably from the aesthetics of the display tray. Glue flap 31 may be seen in the inside of the display tray 3. Panel 35 resides behind both glue flap 31 and the detached cover panel 41 with only a portion of it visible, and is not labeled. The two side panels 32 and 34 along with the front panel 33 of the display tray are visible in the drawing. The bottom flaps are seen closed up and these flaps are not labeled for clarity sake.

In the detached cover portion 2, the roughened edge 218" is seen on the bottom edge of the rear panel 29. This rough edge is due to the detachment of panel 41 from 29 in the opening process. In this particular embodiment, glue flap 25 is seen to remain with the cover portion because it is preferably not glued to the tray portion at all. Lastly, one of the two glue tabs 7 is seen to remain glued to the cover side panel 28. The glue tab 7 (along with its counterpart 6 remaining on the opposite cover side panel that is not visible) has broken off from the tray side panel 34 across perforated line 319 leaving behind the rough edges 319' and 319" as indicated. It is important to note, and integral to the present invention, that the now separate tray and cover portions are not comprised of exactly the same blanks that originally created these portions. Notably, the glue tabs that were part of the tray blank now remain with the cover, and the detachable portion of the rear panel of the cover portion remains glued to the tray portion. Thus, there is an "exchange" of some of the corrugate from the original two blanks in the two separated portions of the carton. The tray "gives up" the glue tabs 6 and 7 to the cover, whereas the cover "gives up" the detachable panel 41 to the tray. In the less preferred embodiment, the cover also "gives up" the lower portion of glue flap 25 to the tray (with breakage across both the locator aperture and the elongated aperture as explained above) if that flap was originally glued to the tray blank.

It is important to note that in the process of opening the fully erected shipping/display carton that each of the three perforated segments (318, 319 and 218) may break at different times. As explained above, it may be advantageous to stagger the positions of tabs 6 and 7 to guarantee that they break away from the tray portion at staggered times. Additionally, and seen in trials with this carton, although lifting up the cover easily breaks the two glue tabs at 318 and 319, the rear perforation tends to "hinge." This may be due in part to the different weight of corrugated board used for the cover blank and the tray blank, wherein it is preferred that a heavier weight be used for the cover blank, in turn giving rise to a stronger perforation line 218 compared to 318 or 319. In that case, once the cover is pulled up in the front to break 318 and 319, it may still be necessary to rip the cover from the tray across perforated line 218 in a separate operation involving a lateral movement of the cover relative to the tray.

We have herein described a shipping/display carton comprised of a cover portion formed from a cover blank and a tray portion formed from a tray blank. The blanks are preferably glued together at only three glue points when the tray blank is laid flat on top of the cover blank in order to form a two-layered blank that may be erected into the present carton. The fully erected carton may be easily broken apart into an attractive display tray and a disposable/recyclable cover by gripping the cover within a grasping aperture and lifting the cover portion up to break the carton apart at only three short perforation lines, namely two side tabs and along the rear of the carton.

We claim:

1. A shipping and display carton 1 comprising:

a. a cover portion 2 formed from a first blank 20, said first blank comprising in combination; (i) a glue flap 25; (ii) a first side panel 26; (iii) a front panel 27 further including a first curvature defining an upper portion of a grasping aperture 80; (iv) a second side panel 28; (v) a two-portion rear panel comprising an upper portion 29 and detachable lower portion 41 separated by a single perforated line 218, said lower portion 41 of said rear panel fully detachable from said first blank 20 by tearing across said perforated line 218; and, (vi) top panels 21, 22, 23, and 24 integrally connected to one or more of said first and second side panels, front panel, and rear panel for closing the top of said carton; and b. a tray portion 3 formed from a second blank 30, said second blank comprising in combination; (i) a glue flap 31; (ii) a first side panel 32 further including at least one glue tab 6 for affixation to said first side panel 26 of said first blank 20, said tab 6 detachable from said tray blank 30 by tearing through a perforated line 318; (iii) a front panel 33 further including a second curvature defining a lower portion of a grasping aperture 80; (iv) a second side panel 34 including at least one glue tab 7 for affixation to said second side panel 28 of said first blank 20, said tab 7 detachable from said tray blank 30 by tearing through a perforated line 319; (v) a rear panel 35; and, (vi) bottom panels 36, 37, 38, and 39 integrally connected to one or more of said first and second side panels, front panel, and rear panel for closing up the bottom of said carton.

2. The carton of claim 1 wherein said glue tab 6 of said second blank 30 is affixed to said first side panel 26 of said first blank 20; said glue tab 7 of said second blank 30 is affixed to said second side panel 28 of said first blank 20; and, said detachable lower portion 41 of said two-portion rear panel of said first blank 20 is affixed to said rear panel 35 of said second blank 30 such that tab 6 and tab 7 remain affixed to said cover portion 2 and such that detachable portion 41 remains affixed to said tray portion 3 when said carton is separated into cover portion 2 and display tray 3.

3. The carton of claim 2 wherein said perforated line 318 comprises from about 20% to about 30% of the length of said first side panel 32.

4. The carton of claim 2, wherein said perforated line 319 comprises from about 20% to about 30% of the length of said second side panel 34.

5. The carton of claim 1 wherein said first curvature of said front panel 27 of said first blank 20 further comprises a series of undulations that form the shape of finger recesses.

6. The carton of claim 1, further including a small locator aperture cut through said glue flap 25 of said first blank 20 and an elongated aperture cut through said first blank 20 between said glue flap 25 and said first side panel 26.

7. The carton of claim 6 wherein said glue flap 25 on said first blank 20 is affixed to said glue flap 31 of said second blank 30.

8. A method of constructing the carton of claim 6 comprising the steps of:

a. placing said tray blank 30 on top of said cover blank 20 while gluing tab 6 to first side panel 26; gluing tab 7 to said second side panel 28; gluing detachable portion 41 of said two-portion rear panel to rear panel 35; and, gluing said glue flap 25 to said glue flap 31; and b. gluing glue flap 25 to upper portion 29 of said two-portion rear panel; and, gluing glue flap 31 to rear panel 35.

9. A method of opening the carton of claim 6 comprising the steps of:

a. grasping within grasping aperture 80;

b. separating said cover portion 2 from said display tray portion 3 by pulling up against said first curvature of said front panel 27 to break or tear across perforated lines 318, 319, 218 and to tear through both of said locator and elongated apertures; and wherein tab 6 remains glued to said first side panel 26; said tab 7 remains glued to said second side panel 28; detachable portion 41 of said two-portion rear panel remains glued to said panel 35; and a portion of said glue flap 25 remains glued to said glue flap 31 after complete separation of the cover portion from the tray portion.

10. A method of constructing the carton of claim 1 comprising the steps of:

a. placing said tray blank 30 on top of said cover blank 20 while gluing tab 6 to first side panel 26; gluing tab 7 to said second side panel 28; and, gluing detachable portion 41 of said two-portion rear panel to rear panel 35; and b. gluing glue flap 25 to upper portion 29 of said two-portion rear panel; and, gluing glue flap 31 to rear panel 35.

11. A method of opening the carton of claim 1 comprising the steps of:

a. grasping within grasping aperture 80;

b. separating said cover portion 2 from said display tray portion 3 by pulling up against said first curvature of said front panel 27 to break or tear across perforated lines 318, 319 and 218; and wherein tab 6 remains glued to said first side panel 26; said tab 7 remains glued to said second side panel 28; and, detachable portion 41 of said two-portion rear panel remains glued to said panel 35 after complete separation of the cover portion from the tray portion.

* * * * *